US005476187A

United States Patent [19]

Marisco

[11] Patent Number: 5,476,187

[45] Date of Patent: Dec. 19, 1995

[54] RETAINER MEANS FOR CONTAINER LINER

[76] Inventor: Frank J. Marisco, 18 Outlook Rd., New Milford, Conn. 06776

[21] Appl. No.: 974,454

[22] Filed: Nov. 12, 1992

[51] Int. Cl.[6] ..... B65D 25/16

[52] U.S. Cl. ..... 220/404; 220/908

[58] Field of Search ..... 220/404, 354, 220/908, 307

[56] References Cited

U.S. PATENT DOCUMENTS

| | | | |
|---|---|---|---|
| 3,052,371 | 9/1962 | Bemmelen | 220/404 |
| 3,458,079 | 7/1969 | Gasbarra | 220/307 |
| 4,279,358 | 7/1981 | Jacobs | 220/354 |
| 4,397,404 | 8/1983 | Blanchette | 220/307 |
| 4,512,494 | 4/1985 | Von Holdt | 220/354 |
| 4,913,308 | 4/1990 | Culbertson | 220/404 |
| 5,005,727 | 4/1991 | Roth | 220/404 |
| 5,058,763 | 10/1991 | Dickinson | 220/404 |
| 5,072,852 | 12/1991 | Smith et al. | 220/404 |
| 5,119,957 | 6/1992 | Joyce-Middaugh | 220/404 |
| 5,181,626 | 1/1993 | Daenen et al. | 220/354 |

*Primary Examiner*—Joseph M. Moy
*Attorney, Agent, or Firm*—Ohlandt, Greeley, Ruggiero & Perle

[57] ABSTRACT

A retainer means for securing a liner to a container having a rim with a grooved section disposed substantially near the top of the container means. The retainer means being of a cross-section such that it fits securely within the grooved section, whereby the liner is securely disposed between the grooved section and the retainer means.

1 Claim, 3 Drawing Sheets

RETAINER MEANS FOR CONTAINER LINER

The present invention is generally directed to a novel retainer means used to secure a liner to the rim of a container, e.g., a garbage pail, diaper bucket and the like.

BACKGROUND OF THE INVENTION

Liners such as plastic garbage bags are normally inserted into a garbage pail or diaper bucket to protect the inside of the container from the matter being disposed therein and to permit easy removal of the contents. Conventional container designs require that the liner be inserted therein and then folded over the top rim of the pail or bucket. Unfortunately, unsecured liners will often fall into the container requiring continuous re-adjustment of the liner about the rim. This is a particular problem when storing hazardous or human waste wherein physical contact with the contents of the container is undesirable and unsanitary.

Others have used elastic bands to secure the liner about the rim of the container. However, elastic bands do not always maintain a secure fitting about the container, especially when heavy loads are placed therein, and are often subject to breaking. The present inventor has developed a novel retainer means which overcomes the need for elastic bands and provides a secure means for affixing the liner about the container even under heavy load conditions. This novel retainer means is as easy to apply as elastic bands, but not subject the physical degradation and breakage commonly associated with elastic bands.

The retainer means according to the present invention not only secures the liner about the container, but can be designed in such a way that it is capable of hiding the excess portion of the liner which normally hangs over the container rim. This excess liner portion is unsightly and provides for an unpleasant aesthetic appearance, especially when the container is placed in public areas.

Thus, the advantage of using the novel retainer means of the present invention is that the liner remains securely affixed about the container even under heavy load conditions and excess portions of the bag can be hidden to provide a much neater appearance.

The present invention also provides many additional advantages which shall become apparent as described below.

SUMMARY OF THE INVENTION

A retainer means for securing a garbage bag liner about a container, such as a garbage pail or diaper bucket. The container means having a rim with a grooved section disposed substantially near the top thereof. The retainer means being of a cross-section such that it fits securely within the grooved section, whereby the liner is securely disposed between the grooved section and the retainer means.

It is preferable that the grooved section comprises at least two side walls wherein each side wall of the grooved section has at least one grooved portion disposed therein. Likewise, the retainer means comprises at least two side walls wherein each side wall has at least one protuberance thereon, wherein each protuberance is disposed about the retainer means such that it securely fits within an oppositely disposed grooved portion when the retainer means is properly seated within the grooved section.

It is also an object according to the present invention wherein the retainer means comprises a top, a bottom and at least two side walls. The bottom of the retainer means preferably including a concave portion which is capable of storing excess liner.

Another object of the present invention is a retainer means having a cross-section such that it fits securely over any rim of a container, whereby a liner is securely disposed between the rim and the retainer means. Preferably, the rim is T-shaped such that it comprises a top portion which is perpendicular to the side wall of the container, and first and second lips disposed at opposite ends of the top portion. In accordance with this embodiment, the retainer means is preferably a hollow rectangular configuration wherein the side of the retainer means disposed opposite to the T-shaped rim is partially open and wherein this partially open side includes third and fourth lips disposed in an opposite direction from the first and second lips of the T-shaped rim; whereby the lips of the retainer means interlock with the lips of the rim.

Other and further objects, advantages and features of the present invention will be understood by reference to the following specification in conjunction with the annexed drawings, wherein like parts have been given like numbers.

DESCRIPTION OF THE PREFERRED EMBODIMENTS

The present invention is directed generally to a novel retainer means for securing a plastic or paper liner to a container such as a garbage pail or diaper bucket. The retainer means fits into a U-shaped or other convenient shaped grooved section positioned about the upper rim of the container. The retainer means can be any desired shaped so long as it fits securely within the corresponding grooved section. It is highly desirable that the retainer means has a configuration which permits the storage of excess liner between the retainer means itself and the grooved section into which it is seated.

The retainer means is seated within the grooved section in such a way that the liner disposed therebetween cannot be forcibly removed without first removing the retainer means from the grooved section.

Figure 1:
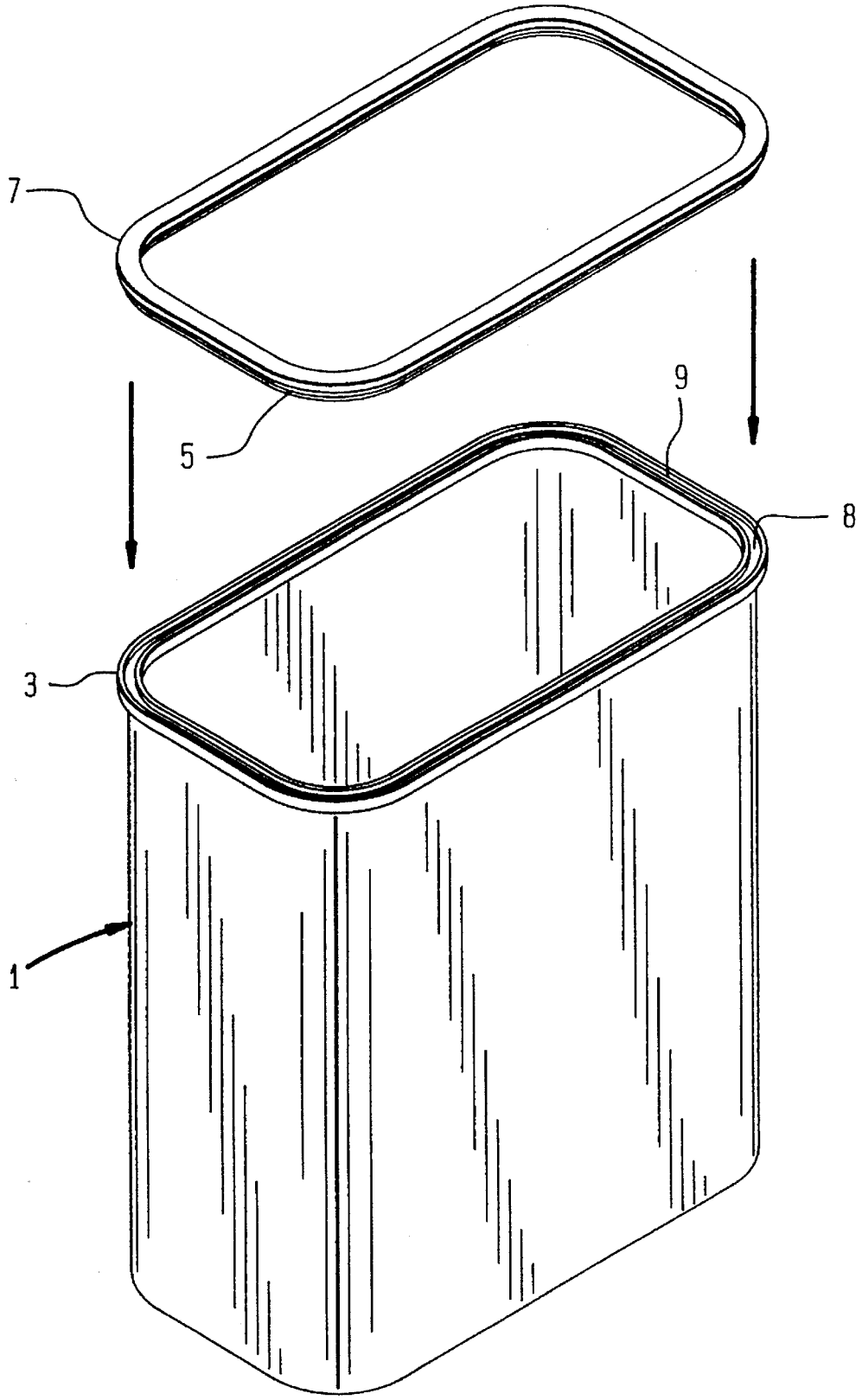
FIG. 1 is a schematic top-side perspective view of a container and retainer means according to the present invention.

The present invention and its various embodiments can best be understood by reference to the attached drawings, wherein FIG. 1 is a schematic perspective view of a container 1 having a rim 3 disposed substantially near the top thereof. A plastic liner, not shown, is preferably disposed between rim 3 and retainer means 7 in such a way that it cannot be forcibly removed without first removing retainer means 7 with protuberance 5 from the grooved section 8 with grooved portion 9.

Figure 2A:
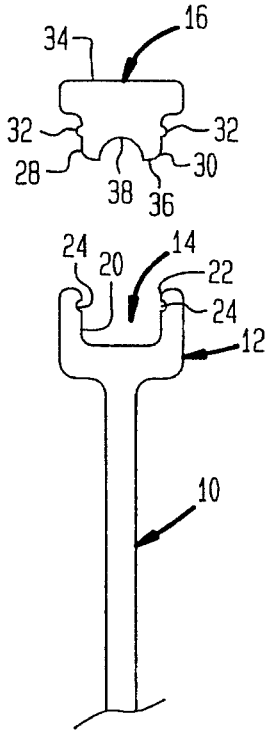
FIG. 2*a* is a schematic cross-sectional view of a container rim and a retainer means in accordance with one embodiment of the present invention.
Figure 2B:
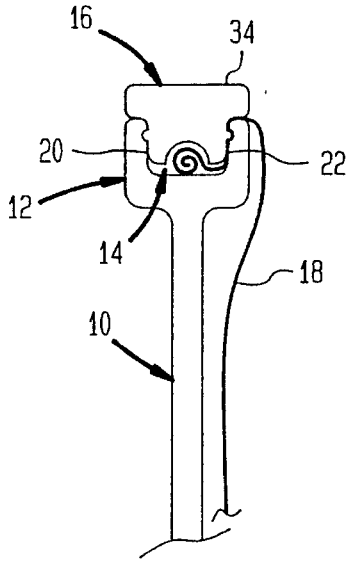
FIG. 2*b* is the cross-sectional view of the embodiment shown in FIG. 2*a* wherein the retainer means is securely seated within the container rim.

FIGS. 2*a* and 2*b* depict a preferred embodiment according to the present invention wherein a container means 10 has a rim 12 with a grooved section 14 disposed substantially near the top of container means 10. A retainer means 16 preferably has a cross-section such that it fits securely within grooved section 14, whereby a liner 18 is securely disposed between grooved section 14 and retainer means 16. It is preferable that grooved section 14 have a U-shaped cross-section, although any other configuration known to the skilled artisan is contemplated herein.

In operation, liner 18 is initially disposed within grooved section 14 and thereafter retainer means 16 is securely seated into grooved section 14.

Grooved section 14 preferably comprises at least two side walls 20 and 22 wherein each side wall (20,22) has at least one grooved portion 24 disposed therein. Retainer means 16 comprises at least two side walls 28 and 30 wherein each side wall (28,30) has at least one protuberance 32 thereon, wherein each protuberance 32 is disposed about retainer means 16 such that it securely fits within an oppositely disposed grooved portion 24 when retainer means 16 is seated within grooved section 14.

Optionally, retainer means 16 may comprise a top 34, a bottom 36 and at least two side walls (28,30), wherein bottom 36 comprising a concave portion 38 capable of storing excess liner 18.

Figure 3:
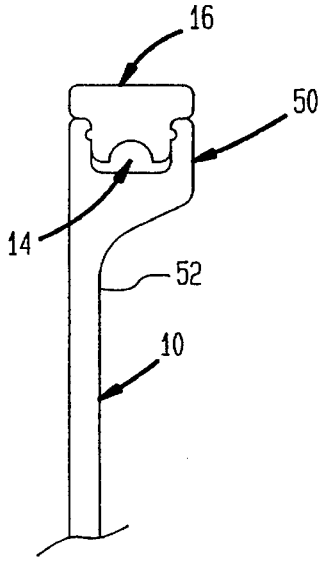
FIG. 3 is a schematic cross-sectional view of a container rim and retainer means wherein the rim is disposed along the inside wall of the container.

FIG. 3 is another embodiment according to the present invention wherein rim 50 is disposed within the interior side wall 52 of container 10.

Figure 4A:
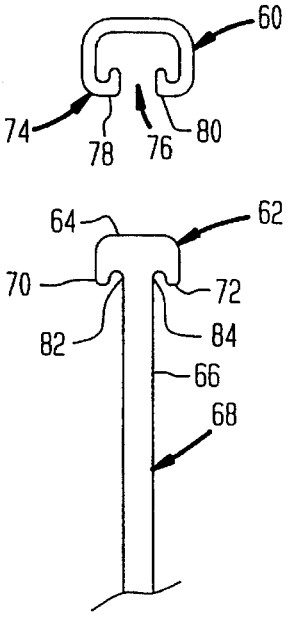
FIG. 4*a* is a schematic cross-sectional view of a container rim and a retainer means in accordance with another embodiment of the present invention.
Figure 4B:
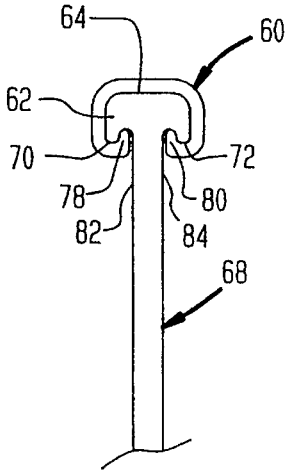
FIG. 4*b* is the cross-sectional view of the embodiment shown in FIG. 4*a* wherein the retainer means is securely seated within the container rim.

FIGS. 4*a* and 4*b* depict yet another embodiment according to the present invention wherein a retainer means 60 has a cross-section such that it fits securely over the top of rim 62, whereby a liner (not shown) can be securely disposed between rim 62 and retainer means 60.

Rim 62 is preferably a T-shaped rim comprising a top portion 64 which is perpendicular to the side wall 66 of container 68, and first and second lips (70 and 72, respectively) disposed at opposite ends of top portion 64. When a T-shaped rim 62 is used it is highly desirable that retainer means 60 have a hollow rectangular configuration wherein the side 74 of retainer means 60 which is disposed opposite to rim 62 has an opening 76 formed by third and fourth lips (78 and 80, respectively) positioned in an opposite direction from that of first and second lips (70,72); whereby retainer means 60 can be securely placed over T-shaped rim 62 such that third lip 78 of retainer means 60 is disposed between first lip 70 of T-shaped rim 62 and the exterior 82 of side wall 66 of container 68 and fourth lip 80 of retainer means 60 is disposed between second lip 72 of T-shaped rim 62 and the interior 84 of side wall 66 of container 68.

Figure 5:
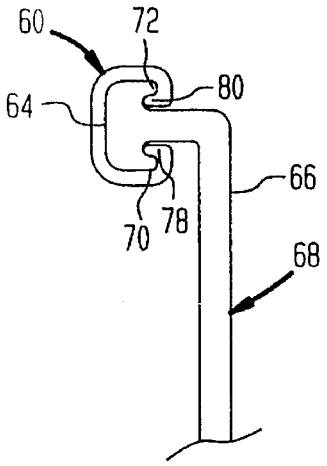
FIG. 5 is another embodiment according to the present invention wherein the container rim is disposed on the side of the container such that the T-shaped rim is parallel to the container wall.

FIG. 5 depicts a similar embodiment to FIGS. 4a and 4b, except that top portion 64 is parallel to side wall 66.

Figure 6:
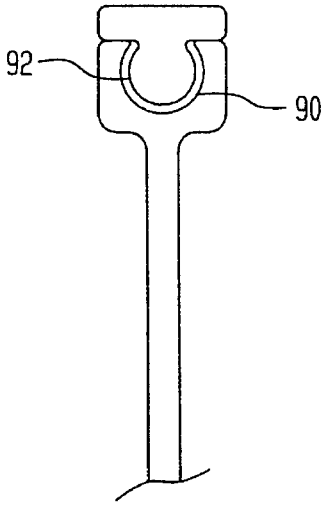
FIG. 6 is another embodiment according to the present invention wherein the container rim has a concave shape and the retainer means has a convex shape to fit therein.

FIG. 6 is another embodiment wherein grooved section 90 has a concave shape and its respective retainer means 92 has a convex shape such that it fits securely within grooved section 90.

Figure 7:
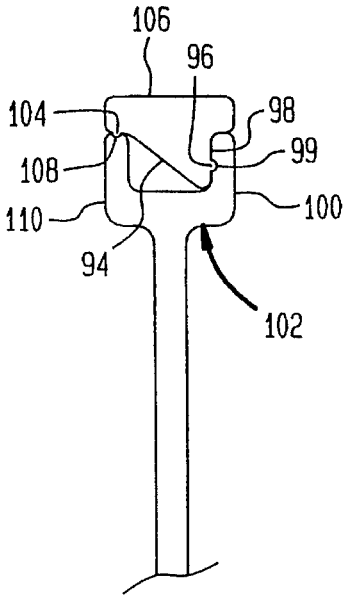
FIG. 7 is still another embodiment according to the present invention wherein the container rim has a U-shape and the retainer means has a triangular shape.

FIG. 7 depicts yet another embodiment wherein retainer means 94 has a triangular shape with a protuberance 96 disposed along side wall 98 which fits securely within grooved portion 99 disposed on side wall 100 of container rim 102. Retainer means 94 also has a protuberance 104 disposed at one end of top portion 106 which fits securely within grooved portion 108 disposed within side wall 110 of container rim 102.

The rim and retainer means can be constructed of any suitably flexible material, such as plastic or rubber, whereby the retainer means can be securely seated within or about the rim of any conventional container.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

What is claimed is:

1. A container means and a retainer means which is capable of securing a liner to said container means, said container means having a rim with a grooved section disposed substantially near the top of said container means, said grooved section comprises at least two side walls wherein at least one side wall of said grooved section has at least one grooved portion disposed therein, and said retainer means being of a cross-section such that it fits securely within said grooved section without impeding external access to the interior of said container when said retainer means is securely disposed within said grooved section and wherein said retainer means comprises a top, a bottom and at least two side walls, said bottom comprising a concave portion capable of storing excess liner and wherein at least one side wall of said retainer means has at least one protuberance thereon, wherein each protuberance is disposed about said retainer means such that it securely fits within an oppositely disposed grooved portion when said retainer means is seated within said grooved section, whereby said liner is securely disposed between said grooved section and said retainer means such that said liner is accessible to those outside of said container without the need for removing said retainer means.

* * * * *